US011740024B2

(12) United States Patent
Makepeace et al.

(10) Patent No.: US 11,740,024 B2
(45) Date of Patent: Aug. 29, 2023

(54) MELTING AND/OR STIRRING OF MOLTEN METALS

(71) Applicant: Altek Europe Ltd., Chesterfield (GB)

(72) Inventors: Stephen Makepeace, Chesterfield (GB); Isaac Sewell, Chesterfield (GB)

(73) Assignee: ALTEK EUROPE LIMITED, Chesterfield (GB)

( * ) Notice: Subject to any disclaimer, the term of this patent is extended or adjusted under 35 U.S.C. 154(b) by 334 days.

(21) Appl. No.: 16/462,034

(22) PCT Filed: Nov. 27, 2017

(86) PCT No.: PCT/GB2017/053561
§ 371 (c)(1),
(2) Date: May 17, 2019

(87) PCT Pub. No.: WO2018/096366
PCT Pub. Date: May 31, 2018

(65) Prior Publication Data

US 2019/0301806 A1 Oct. 3, 2019

(30) Foreign Application Priority Data

Nov. 26, 2016 (GB) ..... 1620025
Nov. 26, 2016 (GB) ..... 1620026

(51) Int. Cl.
*F27D 27/00* (2010.01)
*B01F 13/08* (2006.01)
(Continued)

(52) U.S. Cl.
CPC ..... *F27D 27/00* (2013.01); *B01F 33/451* (2022.01); *B01F 2101/45* (2022.01); *F27D 2003/0039* (2013.01)

(58) Field of Classification Search
CPC ..... B01F 13/0809; B01F 2215/0075; B01F 2101/45; B01F 33/451; F27D 2003/0039; F27D 27/00
(Continued)

(56) References Cited

U.S. PATENT DOCUMENTS 7,815,846 B2 * 10/2010 Takahashi ..... F27D 27/00 266/233
8,623,271 B2 * 1/2014 Guest ..... F27D 27/005 266/241
(Continued)

FOREIGN PATENT DOCUMENTS

CN 103582794 A 2/2014
EP 1612498 A1 1/2006
(Continued)

OTHER PUBLICATIONS

International Search Report and Written Opinion from counterpart International Patent Application No. PCT/GB2017/053561 dated Feb. 7, 2018, 13 pages.
(Continued)

*Primary Examiner* — Scott R Kastler
*Assistant Examiner* — Michael Aboagye
(74) *Attorney, Agent, or Firm* — Norton Rose Fulbright US LLP

(57) ABSTRACT

A method and apparatus for moving molten material within a container are provided. The method comprising: providing apparatus including an electromagnetic mover adjacent a part of the container, wherein the electromagnetic mover has a primary motion axis, the primary motion axis being aligned along the direction of the maximum linear force generated by the electromagnetic stirrer; applying a current to the electromagnetic mover such that changes in magnetic field configuration cause movement of the molten metal
(Continued)

within the container; wherein the primary motion axis is inclined relative to the vertical in two different planes; or wherein the longitudinal axis is inclined relative to the vertical in two different planes. The method and apparatus are designed to generate a plurality of different flow zones within the container and/or larger container, the different flow zones differing from one another in terms of their position in the container and/or larger container and/or the different flow zones differing from one another in terms of the relative flow velocities and/or the different flow zones differing from one another in terms of the relative directions of flow.

15 Claims, 18 Drawing Sheets

(51) Int. Cl.
*B01F 33/451* (2022.01)
*F27D 3/00* (2006.01)
*B01F 101/45* (2022.01)

(58) Field of Classification Search
USPC .... 266/234, 200, 900, 233; 75/10.14, 10.16, 75/10.67
See application file for complete search history.

(56) References Cited

U.S. PATENT DOCUMENTS

| | | | | |
|---|---|---|---|---|
| 8,876,934 | B2 * | 11/2014 | Eriksson | C21C 7/00 75/10.67 |
| 9,360,255 | B2 * | 6/2016 | Eriksson | C21C 5/4653 |
| 9,416,430 | B2 * | 8/2016 | Guest | F27B 3/045 |
| 11,002,485 | B2 * | 5/2021 | Peel | F27D 27/00 |
| 2004/0135297 | A1 * | 7/2004 | Houghton | B01F 13/0809 266/234 |

FOREIGN PATENT DOCUMENTS

| | | | | |
|---|---|---|---|---|
| GB | 2488804 | A | 9/2012 | |
| JP | S51 28530 | A | 3/1976 | |
| JP | S5128530 | * | 3/1976 | F27D 27/00 |
| JP | S5645693 | B2 | 12/2014 | |
| WO | WO 2003/106908 | | 12/2003 | |

OTHER PUBLICATIONS

Office Action issued in Corresponding European Application No. 17808124.6, dated Feb. 12, 2021.

* cited by examiner

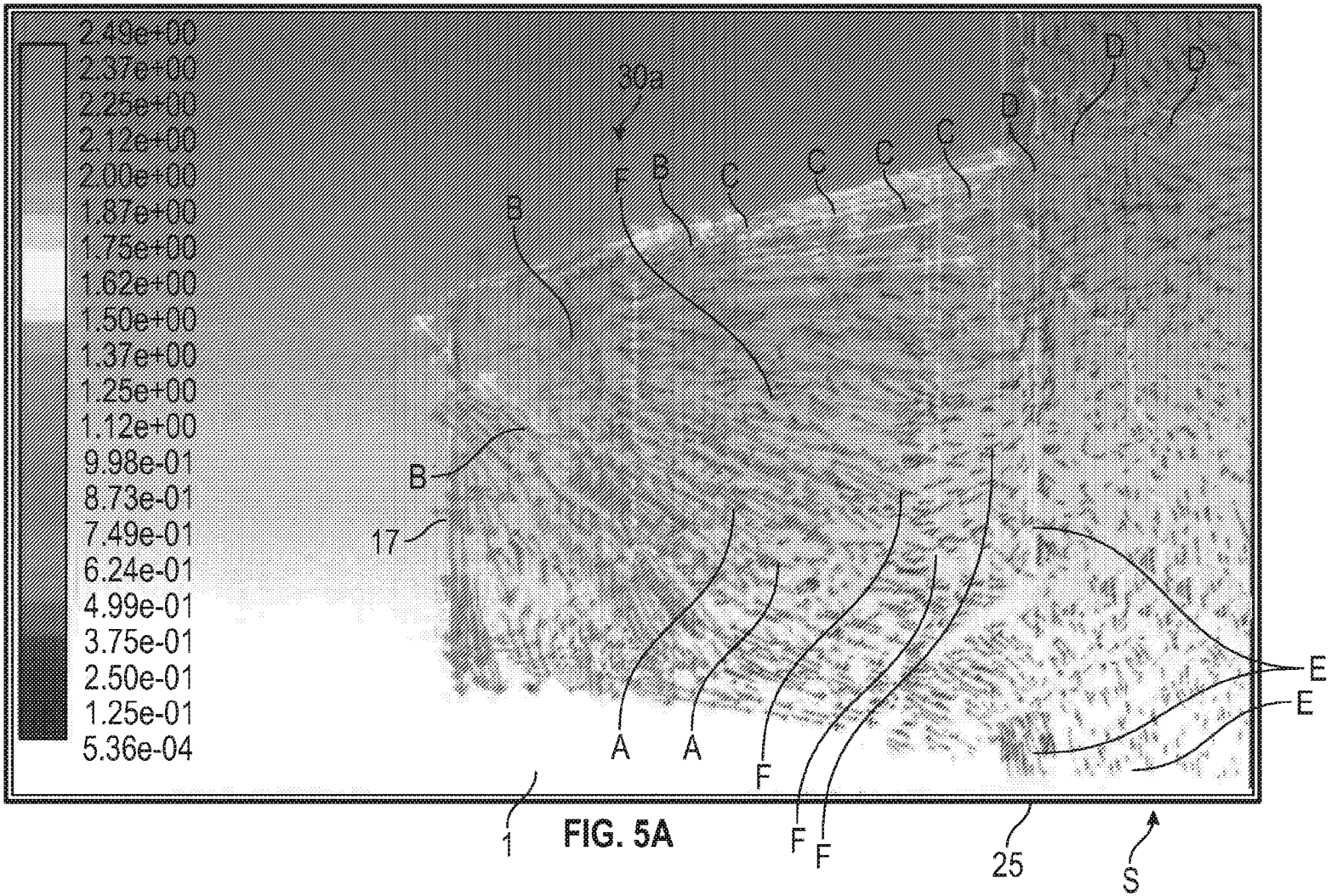
2.43e+00
2.37e+00
2.25e+00
2.13e+00
2.00e+00
1.87e+00
1.75e+00
1.62e+00
1.50e+00
1.37e+00
1.25e+00
1.12e+00
9.98e-01
8.73e-01
7.49e-01
6.24e-01
4.99e-01
3.75e-01
2.50e-01
1.25e-01
5.36e-04
D
D
D
C
C
C

MELTING AND/OR STIRRING OF MOLTEN METALS

FIELD OF INVENTION

The present invention concerns improvements in and relating to melting metals using electromagnetic movers and/or electromagnetic moving, such as stirring, of molten metals, particularly apparatus for stirring and methods of stirring.

BACKGROUND

It is known to use electromagnets to generate moving magnetic fields within molten metal and as a consequence generate motion within the molten metal. The movement causes stirring of the molten metal within its container, with beneficial effects on heat transfer, material dispersion and the like.

There is often a need, for instance when recycling aluminium, to be able to draw non-melted metal down into a body of molten metal to provide melting. Various approaches have been taken to trying to achieve this melting and stirring aim. Electromagnetic movers have been used to try and create suitable flow patterns in the molten metal for such purposes, but the resulting flow patterns are less than optimal.

SUMMARY

The present invention has amongst its potential aims to provide apparatus for stirring and methods of stirring which generate better flow patterns for drawing non-melted metal into molten metal and/or for mixing non-molten metal with molten metal. The present invention has amongst its potential aims to provide apparatus for stirring and methods of stirring which provide optimised molten metal flow out of and into a side chamber to a furnace or other container for molten metal. The present invention has amongst its potential aims to provide apparatus for stirring and methods of stirring which avoid conflicts in the flow of molten metal to a location relative to the flow of molten metal from the location.

According to a first aspect of the invention there is provided apparatus for moving molten metal, the apparatus comprising:

an electromagnetic mover;

a mounting location for the electromagnetic mover;

a support for the mounting location;

wherein the electromagnetic mover has a primary motion axis, the primary motion axis being aligned along the direction of the maximum linear force generated by the electromagnetic stirrer;

wherein the primary motion axis is inclined relative to the vertical in two different planes.

According to a second aspect of the invention there is provided apparatus for moving molten metal, the apparatus comprising:

an electromagnetic mover;

a mounting location for the electromagnetic mover;

a support for the mounting location;

wherein the electromagnetic mover has a longitudinal axis and wherein the longitudinal axis is inclined relative to the vertical in two different planes.

According to a third aspect of the invention there is provided a method of moving molten material within a container, the method comprising:

providing apparatus including an electromagnetic mover adjacent a part of the container, wherein the electromagnetic mover has a primary motion axis, the primary motion axis being aligned along the direction of the maximum linear force generated by the electromagnetic stirrer;

applying a current to the electromagnetic mover such that changes in magnetic field configuration cause movement of the molten metal within the container;

wherein the primary motion axis is inclined relative to the vertical in two different planes.

According to a fourth aspect of the invention there is provided a method of moving molten material within a container, the method comprising:

providing apparatus including an electromagnetic mover adjacent a part of the container, wherein the electromagnetic mover has a longitudinal axis;

applying a current to the electromagnetic mover such that changes in magnetic field configuration cause movement of the molten metal within the container;

wherein the longitudinal axis is inclined relative to the vertical in two different planes.

The third and fourth aspects of the invention may further provide that the apparatus further comprises a mounting location for the electromagnetic mover and a support for the mounting location.

The first, second, third and fourth aspects of the invention may include any of the following features, options and possibilities.

The electromagnetic mover may be a linear motor. The electromagnetic mover may include a core and one or more teeth. The electromagnetic mover may include one or more teeth with an electrical conductor wrapped around. The electromagnetic mover may be provided within a casing. The casing may be a rectangular box.

The mounting location may be provided with fasteners for mounting the electromagnetic mover.

The mounting location may provide a fixed position mounting for the electromagnetic mover. The mounting location may allow for rotational movement of the electromagnetic mover, for instance to vary the inclination of the electromagnetic mover in the second plane relative to the vertical. The mounting location may allow for movement of the electromagnetic mover to vary the extent to which the electromagnetic mover is reclined, for instance in the first plane relative to the vertical. The mounting location may be rotationally mounted on the support. The mounting location may be pivotally mounted on the support. The mounting location may comprise a framework, for instance a rectangular framework.

The support for the mounting location may be moveable, for instance using wheels. The support may provide a framework upon which the mounting location is provided. The support may allow the mounting location to have a variable inclination, for instance through being able to rotate. The support may allow the mounting location to have a variable extent of recline, for instance through being pivotally moveable. The support may comprise a framework, for instance a base frame and one or more uprights extending therefrom upon which the mounting location is provided.

The container may be a feed route for non-molten metal to the container or a larger container connected to the container. The container may be a well. The container may be an exit route for molten metal from the container or a larger container to a third container. The container may be provided on the side of the larger container. The container may be fluidly connected to the larger container.

The container may be defined by a first side wall, a second side wall, a base wall, a back wall and a front wall. The back wall may be part of the larger container. The aperture may be provided in the back wall. The back wall may be vertical+/−10°. The side walls may be vertical+/−20°. The first side wall and second side wall may taper towards one another away from the back wall. The first side wall and/or second side wall may be planar. The base wall may be horizontal+/−10°. The base wall may be planar. The front wall may be angled at 30°, −10°, +20° to the vertical. The front wall may be planar. The front wall may lean outward away from the back wall further at the top of the front wall than at the bottom.

The larger container may be a furnace or molten metal holding chamber. The larger container may have at least 10× the volume of the container, more preferably at least 20× and ideally at least 50×.

The third container may be a discrete container, such as a ladle, or may be a transfer route to another location, such as a launder.

The container may be mounted on a side wall of the larger container. The larger container may be rectilinear in plan and the container may be mounted on a long wall of the larger container and most preferably in a mid-section. The mid-section may be the section which includes the mid-point of the side and 20% of the length either side thereof.

The container may be fluidly connected to the larger container by only a single aperture. The single aperture may provide an entrance area for molten metal entering the container from the larger container. The single aperture may provide an exit area for molten metal exiting the container to the larger container. The entrance area and the exit area may be separated from one another in use by a zone of low velocity molten metal. The velocity may be low compared with the velocity into the container via the entrance area and/or compared with the velocity out of the container via the exit area, for instance a velocity less than 20% thereof, more preferably less than 10% thereof.

The operative location for the electromagnetic mover may be adjacent the front wall of the container. Adjacent may refer to an average, more preferably maximum, airgap between the electromagnetic mover and the front wall of less than 10 cm, more preferably less than 5 cm and ideally less than 3 cm.

The angle of overhang for the front wall of the container may match the recline of the electromagnetic mover+/−5° more preferably +/−1° and ideally +/−0.3°. The top part of the front face of the container may overhang a part of the electromagnetic mover, particularly the middle and/or bottom thereof. The front wall of the container and the electromagnetic mover, particularly the face thereof opposing the front wall of the container, may be parallel to one another.

The electromagnetic mover may have a primary motion axis, the primary motion axis being aligned along the direction of the maximum linear force generated by the electromagnetic stirrer. The primary motion axis corresponds to the primary axis along which molten metal moves. The primary motion axis is preferably parallel to the longitudinal axis of the electromagnetic mover.

The electromagnetic mover may have a longitudinal axis. The longitudinal axis may comprise the centreline for the body electromagnetic mover. The longitudinal axis may comprise the centreline of the face of the electromagnetic mover opposing the front wall of the container.

The primary motion axis may be inclined relative to the vertical in a first plane due to the electromagnetic mover being reclined away from the container and/or larger container. The electromagnetic mover may be reclined such that the upper part of the electromagnetic mover is further from the larger container than the lower part of the electromagnetic mover. The primary motion axis may be inclined relative to the vertical in a first plane by between 20° and 65°, preferably between 25° and 45°, for instance 30°+/−5°.

The primary motion axis may be inclined relative to the vertical in a second plane due to the electromagnetic mover being rotated from the vertical. The electromagnetic mover may be inclined such that the upper part of the electromagnetic mover is to the left side or right side of the front wall of the container and the lower part of the electromagnetic mover is to the other of the right side or the left side of the front wall of the container. The primary motion axis may be inclined relative to the vertical in a second plane by between 3° and 50°, preferably between 5° and 35°, more preferably between 5° and 15° and ideally between 6° and 12°, for instance 8°+/−1°.

The longitudinal axis may be inclined relative to the vertical in a first plane due to the electromagnetic mover being reclined away from the container and/or larger container. The electromagnetic mover may be reclined such that the upper part of the electromagnetic mover is further from the larger container than the lower part of the electromagnetic mover. The longitudinal axis may be inclined relative to the vertical in a first plane by between 20° and 65°, preferably between 25° and 45°, for instance 30°+/−5°.

The longitudinal axis may be inclined relative to the vertical in a second plane due to the electromagnetic mover being rotated from the vertical. The electromagnetic mover may be inclined such that the upper part of the electromagnetic mover is to the left side or right side of the front wall of the container and the lower part of the electromagnetic mover is to the other of the right side or the left side of the front wall of the container. The longitudinal axis may be inclined relative to the vertical in a second plane by between 3° and 50°, preferably between 5° and 35°, more preferably between 5° and 15° and ideally between 6° and 12°, for instance 8°+/−1°.

Preferably the linear force is directed upward along the primary motion axis. Preferably the linear force is directed upward along the longitudinal axis. The direction of the linear force is preferably determined by the control system for the electromagnetic mover.

The linear force may be applied in a single direction. The linear force may be applied in a single direction for one or more first time periods. The linear force may be absent for one or more second time periods. The linear force may be applied in a second direction, such as downward, for one or more third time periods. The first, second and third time periods may be combined in various sequences. The reverse direction for the linear force may be applied periodically.

The method may include generating a plurality of different flow zones within the container and/or larger container. The different flow zones may differ from one another in terms of their position in the container and/or larger container. The different flow zones may differ from one another in terms of the relative flow velocities. The different flow zones may differ from one another in terms of the relative directions of flow.

A first flow zone may be generated in a middle and/or upper part of the container. The first flow zone may feed molten metal to a second flow zone. The first flow zone may include intermediate and/or low flow velocities. The first flow zone may include flows away from the larger container and/or across the container, particularly diagonally across the container. The first flow zone may include horizontal and/or moderate rising flows. The first flow zone may include flow towards the junction of the angled front wall of the container and a side wall of the container. The first flow zone may be fed non-molten metal to be melted. The first zone may be Zone A of the illustrations.

A second flow zone may be generated in the middle and/or upper part of the container. The second flow zone may receive molten metal from the first flow zone and/or a sixth zone. The second flow zone may feed molten metal to a third flow zone. The second flow zone may include high and/or very high flow velocities. The second flow zone may include flow away from the larger container which then turns to flow towards the larger container. The second flow zone may include flow across the container, potentially in a moderate rising flow. The second flow zone may then provide flow down and along the side wall of the container, preferably with a strong downward flow. The second flow zone may include a moderate rising flow flowed by a strong downward flow. The second flow zone may include flow down the junction of the angled front wall of the container and side wall of the container and/or down the angled front wall of the container and/or along the side wall of the container. The second flow zone may be to one side only of the container. The second flow zone is preferably absent from the other side of the container and/or from the middle of the container. The second flow zone may submerge the non-molten metal. The second flow zone may be Zone B of the illustrations.

A third flow zone may be provided in the middle and/or lower part of the container and/or lower part of the larger container. The third flow zone may receive molten metal from the second flow zone. The third flow zone may feed molten metal to the fourth flow zone. The third flow zone may include high and/or very high flow velocities. The third flow zone may include flow toward the larger container and/or into the larger container. The third flow zone may provide flow down and along the side wall of the container and/or along the base of the container and/or along the base of the furnace. The third flow zone may be to one side only of the container. The third flow zone is preferably absent from the other side of the container and/or from the middle of the container. The third flow zone may further submerge and/or melt the non-molten metal feed to the container. The third flow zone may be Zone C of the illustrations.

A fourth flow zone may be provided in the lower part of the larger container. The fourth flow zone may receive molten metal from the third flow zone. The fourth flow zone may feed molten metal to a fifth flow zone and/or a sixth flow zone. The fourth flow zone may include high flow velocities. The fourth flow zone may include flow away from the container across the larger container. The fourth flow zone may provide flow across the base of the larger container and/or across the middle level part of the larger container. The fourth zone may be provided only to one side of the middle of the larger container. The fourth flow zone may be absent from either ends of the larger container. The fourth flow zone may provide further melting of the non-melted metal feed to the container. The fourth flow zone may be Zone D of the illustrations.

A fifth flow zone may be provided in the lower part and/or middle part of the larger container. The fifth flow zone may receive molten metal from the fourth flow zone. The fifth flow zone may feed molten metal to a sixth flow zone. The fifth flow zone may include low and/or very low flow velocities. The fifth flow zone may include flow from the larger container towards and/or into the container. The fifth flow zone may provide flow across the base of the larger container and/or across the middle level of the container. The fifth zone may be provided in the part of the larger container facing one side of the container and/or facing the middle of the container. The fifth flow zone may be absent for the part of the larger container facing the other side of the container, particularly the part of the container with the third flow zone. The fifth flow zone may provide molten metal to the container. The fifth flow zone may be Zone E in the illustrations.

A sixth flow zone may be provided in the lower and/or middle part of the container. The sixth flow zone may receive molten metal from the fifth flow zone. The sixth flow zone may feed molten metal to the first flow zone and/or second flow zone. The sixth flow zone may include low and/or moderate flow velocities. The sixth flow zone may include from close to the larger container further into the container. The sixth flow zone may include flow across the base of the container and/or through the middle depth of the container. The sixth zone may be provided in one side of the container and/or in the middle of the container. The sixth flow zone may be absent from the other side of the container, particularly the part of the container with the third flow zone. The sixth flow zone may provide molten metal to the angled end wall of the container. The sixth flow zone may be Zone F in the illustrations.

The inclination of the electromagnetic mover, relative to the vertical in the first plane, may be varied with time. The inclination of the electromagnetic mover, relative to the vertical in the second plane, may be varied with time. Preferably no variation with respect to the vertical in the first plane occurs with time, but variation to the vertical in the second plane does occur. The variation in the inclination with time may arise as a result of feedback from one or more sensors. The variation in the inclination with time may arise as a result of the volume and/or level of molten metal within the container and/or larger container. The inclination may be greater when the volume and/or level of molten material is lower. The inclination may be less when the volume and/or level of molten metal is higher. The variation in the inclination with time may arise as a result of whether or not non-molten material is being fed to the container. The inclination may be greater when non-molten metal is not being added to the container. The inclination may be less when non-molten metal is being added to the container.

The electromagnetic mover may be moveable to a further location. The electromagnetic mover may be moveable by movement of the mounting location and/or the support for the mounting location. The further location may be proximate to the same larger container. The further location may be a location for the removal of molten metal from the larger container and/or from a further container connected to the larger container.

The further location may include an inclined wall. The inclined wall may be a part of the larger container or may be connected to the larger container. The inclined wall may be part of a further container for molten metal, with the molten metal being in fluid communication with the molten metal of the larger container.

The electromagnetic mover may be provided adjacent to the inclined wall. The electromagnetic mover may force molten metal up the inclined wall. The molten metal may be forced up and over the end of the inclined wall. The molten metal may be forced out of the further container and into a receptacle such as a ladle, yet further container or launder. The molten metal may flow away from the location.

The inclined wall may be inclined at more than 40° to the vertical, preferably more than 45°, still more preferably more than 50° and potentially more than 60°. The electromagnetic mover may have a matching inclination. The electromagnetic mover may be inclined only in one plane relative to the vertical. The longitudinal axis of the electromagnetic mover may be aligned with the longitudinal axis of the inclined wall. The primary motion axis of the electromagnetic mover may be aligned with the longitudinal axis of the inclined wall.

The inclined wall may include a metal plate. The metal plate may extend above the resting level of molten metal in the larger container or further container. The metal plate may extend at least 50 mm, preferably 80 mm and ideally at least 100 mm above the resting level.

The first, second and third aspects of the invention may include any of the following features, options and possibilities, together with those set out in the specific description and elsewhere within the application.

The method of stirring may be a method of stirring molten metal. The method of stirring may be a method of stirring aluminium.

The non-molten metal may be aluminium, for instance chips of aluminium.

The method of stirring may be a method of stirring a furnace. The method of stirring may be a method of stirring a ladle, storage vessel, transport vessel, holding furnace.

The method of stirring may be a method of stirring using a side mounted stirrer.

A apparatus may further include one or more of: a casing for the apparatus; a support frame; one or more cooling spaces; a control system. The support frame may support the core and/or one or more or all of the coils of electrical conductor and/or the control system.

The support frame may support the core and/or teeth and/or electrically conducting coils and/or casing for the apparatus and/or cooling system and/or control system. The support frame preferably maintains a consistent position for the support the core and/or teeth and/or electrically conducting coils and/or casing for the apparatus during the application of and removal of current to one or more or all of the electrically conducting coils.

The one or more cooling spaces may be provided within the apparatus and be in fluid communication with a source of coolant.

The control system may control the current and/or voltage and/or timing thereof and/or duration thereof for one or more and preferably all of the electrically conductive coils. The control system may control the phases and/or phasing of activation and/or deactivation of the magnetic field and/or current to the electrically conductive coils. The control system may apply a current to at least one of the electrically conducting coils at a first time to generate a first magnetic field configuration and/or applying a current to at least one of the other electrically conducting coils at a second time to generate a second magnetic field configuration, such that the changes in magnetic field configuration cause movement of the molten metal within the container. A three phase electromagnetic mover may be provided.

The core is preferably formed of a ferromagnetic material, such as iron or steel. The core preferably integrally provides the connection base and the teeth extending therefrom.

The connections preferably provide for the separate application of current to the separate electrically conducting coils. The connections preferably allow a single power supply to provide the current to the separate electrically conducting coils.

The support may be moved from one location to another using rails.

The wall of the container facing the electromagnetic mover may be formed of a metal plate, for instance a stainless steel plate. The plate may be the full depth through to the molten metal, but it is preferred that the plate abuts a refractory material and the refractory material contacts the molten metal.

BRIEF DESCRIPTION OF THE DRAWINGS

Various embodiments of the invention will not be described, with reference to the accompanying drawings by way of example only, in which:

FIG. 2*aa* illustrates more schematically the flow paths and flow velocities for a first orientation of the electromagnetic mover;

FIG. 3*aa* illustrates more schematically the flow paths and flow velocities for a second orientation of the electromagnetic mover unit;

FIG. 5*aa* illustrates more schematically the flow paths and flow velocities for the same instance as FIG. 5*a;*

FIG. 5*bb* illustrates more schematically the flow paths and flow velocities for the same instance as FIG. 5*b;*

FIG. 5*cc* illustrates more schematically the flow paths and flow velocities for the same instance as FIG. 5*c;*

FIG. 5*dd* illustrates more schematically the flow paths and flow velocities for the same instance as FIG. 5*d*.

DETAILED DESCRIPTION

In a variety of instances, it is desirable to be able to introduce materials to a furnace or other container of molten metal and effectively disperse the introduced material in the molten metal. The introduced material could be one or more treatment additives for the molten metal. A commonly encountered situation, however, is one in which recycled aluminium in the form of aluminium chips needs to be melted for processing and reuse. The aluminium chips are relatively buoyant and so present difficulties in fully introducing them to the molten metal at a high rate. It is desirable to be able to quickly contact the non-melted metal with the existing molten metal and so promote fast melting of the newly introduced metal.

One option for achieving the above is to create a downward flow of molten metal at a location, such that non-melted metal introduced to the location is drawn with the flow down into the melt. The flow then preferably passes out into the furnace where the bulk of the molten metal is being held and where the heat input is provided. To maintain the flow, there needs to be a matching inward flow to the location of hot molten metal.

Figure 1:
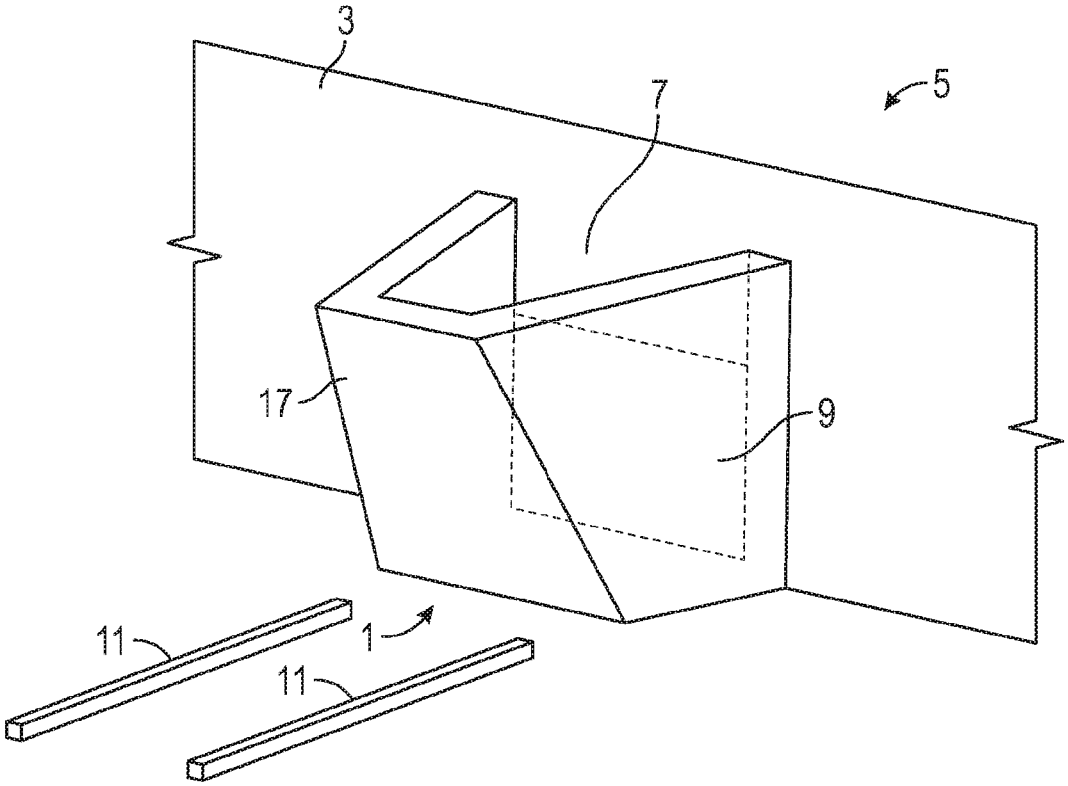
FIG. 1 illustrates a well for the submergence of scrap metal attached to the side of a furnace for melting metal.

FIG. 1 shows a perspective view of a well 1 attached to the side wall 3 of a furnace 5. The well 1 has an open top 7 into which non-melted metal can be introduced using a suitable material handling system (not shown) to provide a steady flow of the non-melted metal. An opening 9 in the side wall 3 of the furnace 5 provides fluid communication between the inside of the well 1 and the inside of the furnace 5.

The well 1 is a separate unit to the rest of the furnace 5 and so it is possible to provide different configurations of well 1 in terms of the internal profile and shape of the well 1 to a limited extent. However, it is rarely acceptable to materially change the interface between the well 1 and the furnace 5, for instance by forming new openings into the furnace 5, removing parts of the furnace 5 internal profile or adding to that profile. Hence, there is a strong need to identify solutions which work with the exiting profile and can readily be retrofitted to a pre-existing furnace.

Returning to FIG. 1, the rails 11 allow a moveable cradle 13 (see FIG. 4) to be brought into an operative position (see FIG. 4) relative to the well 1 or removed to an inoperative position (not shown). The cradle 13 includes a mounting frame 15. In use, the mounting frame 15 receives the electromagnetic mover unit (not shown) and presents it to the angled front wall 17 of the well 1. The mounting frame 15 and hence the electromagnetic mover unit are angled in a manner which matches the angle of the angled front wall 17 of the well 1. In this way the airgap between the angled front wall 17 and the opposing face of the electromagnetic mover unit is minimised.

Achieving the optimum flow within the well 1 and the furnace 5 is a significant problem.

Figure 2A:
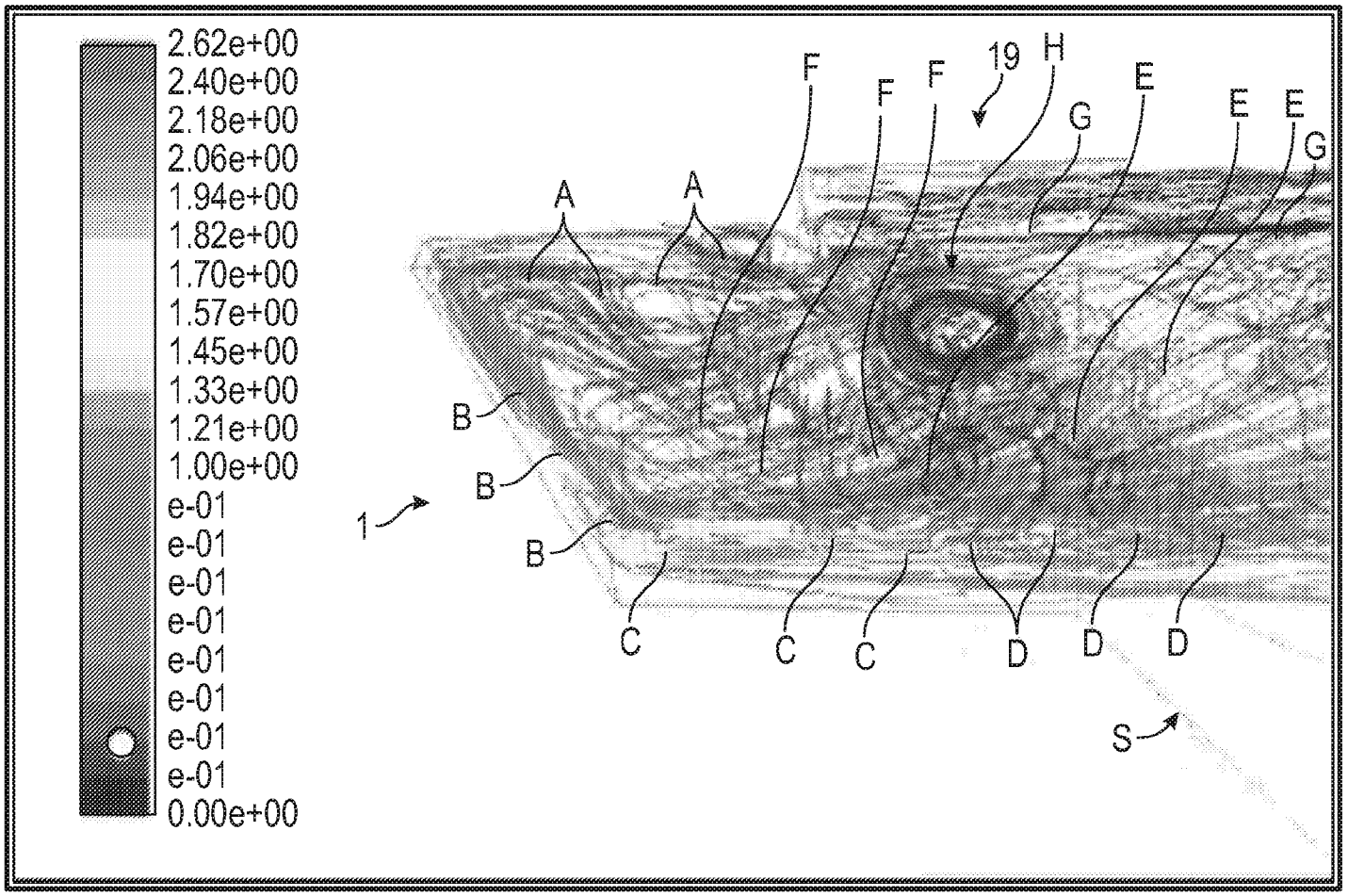
FIG. 2*a* illustrates flow paths and flow velocities for a first orientation of the electromagnetic mover unit.
Figure 2A:
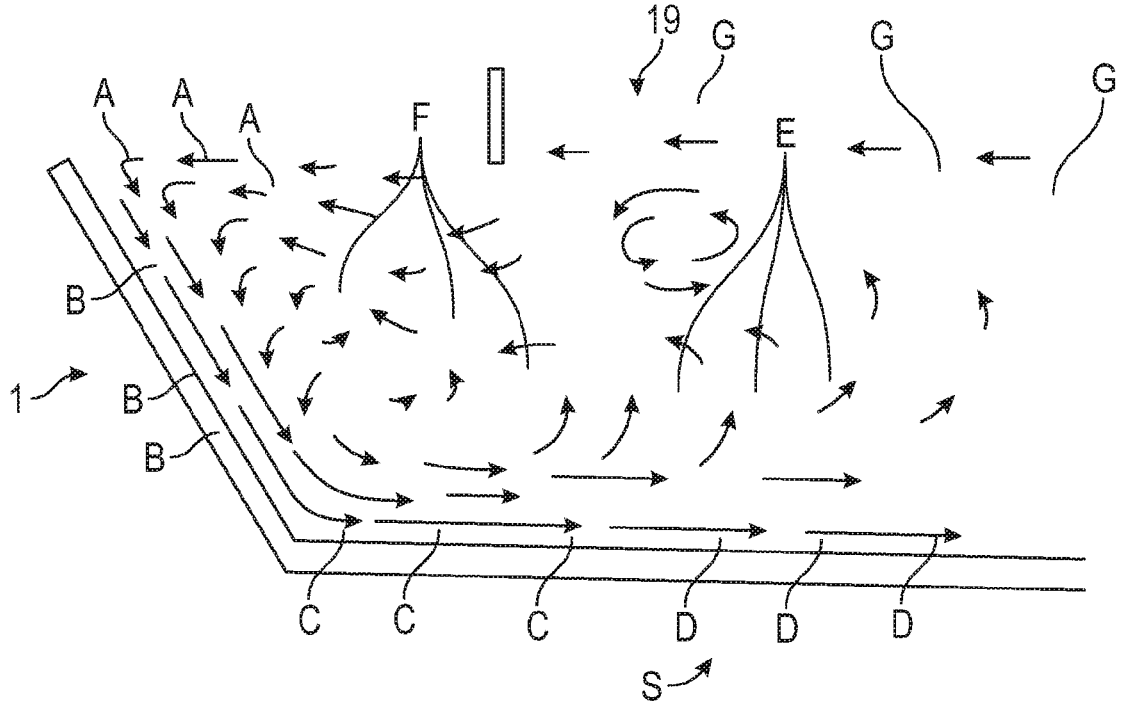

FIG. 2*a* shows the resulting flow paths and flow velocities within the well 1 and the initial part 19 of the furnace 5 with the electromagnetic mover unit 21 in a first orientation. The first orientation is shown in FIG. 2*b*.

Figure 2B:
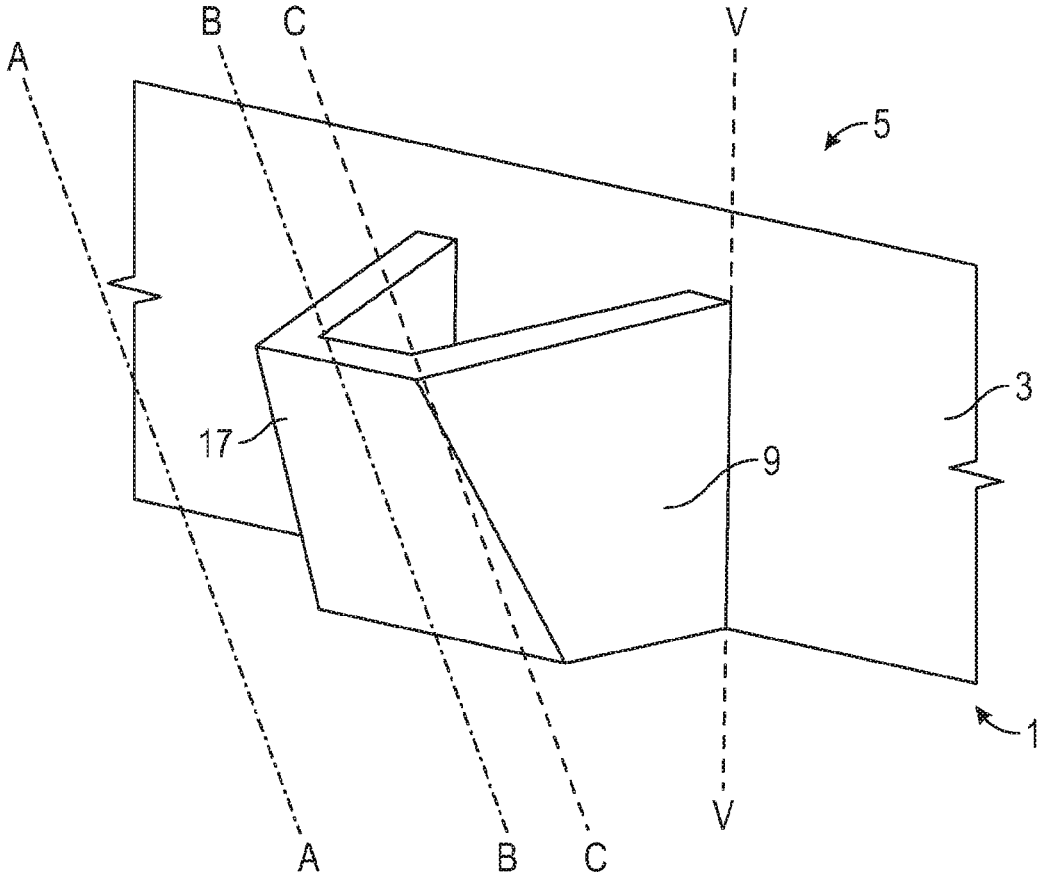
FIG. 2*b* illustrates the first orientation of the electromagnetic mover unit and the resulting primary movement effect.

Referring to FIG. 2*b*, axis V-V shows the vertical axis for the system. In this case, that corresponds to the vertical side wall 3 of the furnace 5. The angled front wall 17 of the well 1 is planar and its centreline defines the primary axis B-B of the angled front wall 17. The primary axis A-A of the electromagnetic mover unit 21, the axis running down through the centre of the electromagnetic mover 21, is parallel to the primary axis B-B of the angled front wall 17 as it is reclined to the same extent. The electromagnetic mover unit 21 is effectively a linear motor and so the primary motion axis in the molten metal generated by the magnetic flux is along axis C-C, downward.

Whilst establishing the primary motion axis C-C in FIG. 2*b* is relatively predictable, the actual flow paths and velocities shown in FIG. 2*a* reflect the complexity of the outcome in practice. In zone A at the top surface of the molten metal within the well 1, the flow velocity is relatively low and towards the top of the angled front wall 17 of the well. This is reflected in the short arrows to indicate direction and velocity. In Zone B at the face of the angled front wall 17 of the well 1, high downward velocities are observed (long arrows). These two flows function to an extent to draw aluminium chips introduced to Zone A down into the well 1. In Zone C, the high velocity flow passes across the bottom surface 23 of the well 1 and out of the well 1. Horizontal flow continues into Zone D in the bottom part of the furnace, but flow upward into Zone E also occurs. Zone E is at the junction between the well 1 and the furnace 5 and a significant volume of metal at low velocity flows from this zone back to Zone F in the middle of the well. The flow to Zone F provides the flow to Zone B where the main motion caused by the electromagnetic mover unit 21 arises. As a consequence of the above flow pattern a lot of the metal in the well 1 recycles over and over within the well 1. This results in the temperature of the molten metal within the well 1 dropping and causing problems as heat is not drawn into the well from the furnace, Zone G and beyond. In addition, there is limited flow of the new material out into the furnace, Zone G and beyond and so mixing is poor. There are also numerous other undesirable flow paths, for instance recirculating flow at Zone H in the upper part of the boundary between the well 1 and the furnace 5.

Figure 3A:
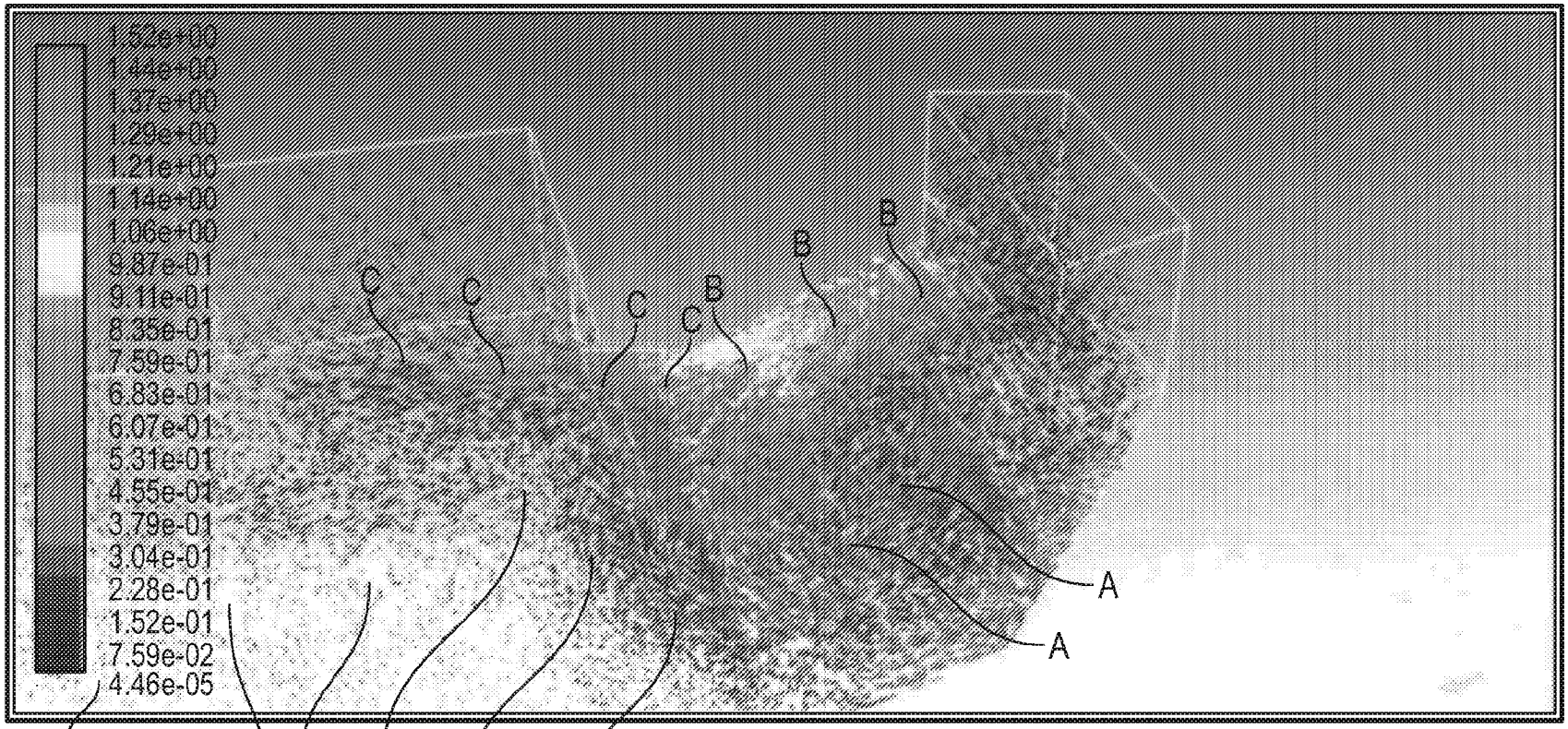
FIG. 3*a* illustrates flow paths and flow velocities for a second orientation of the electromagnetic mover unit.
Figure 3A:
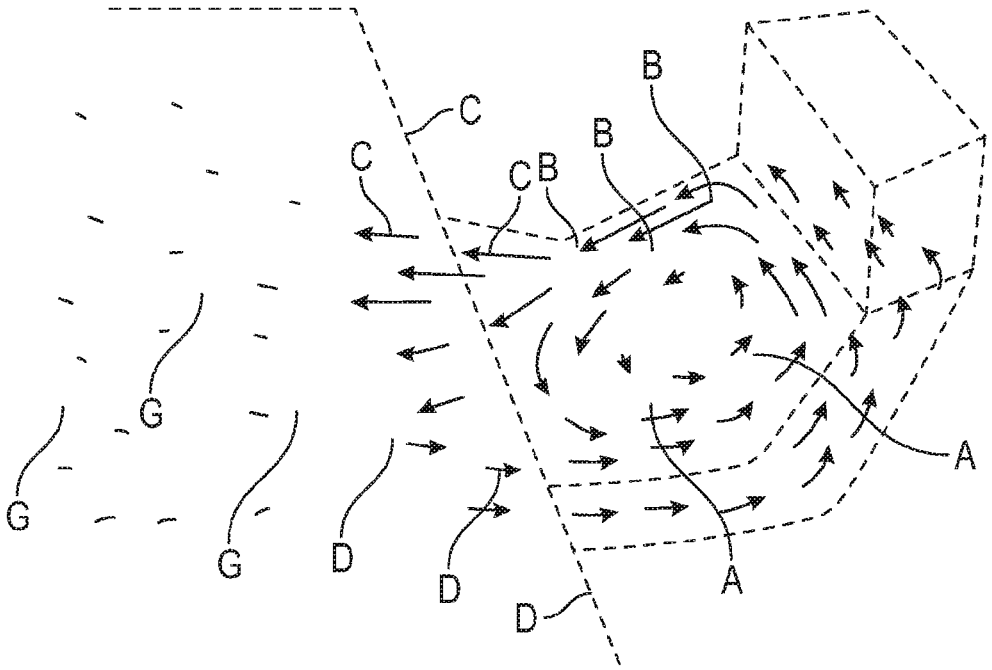
Figure 3B:
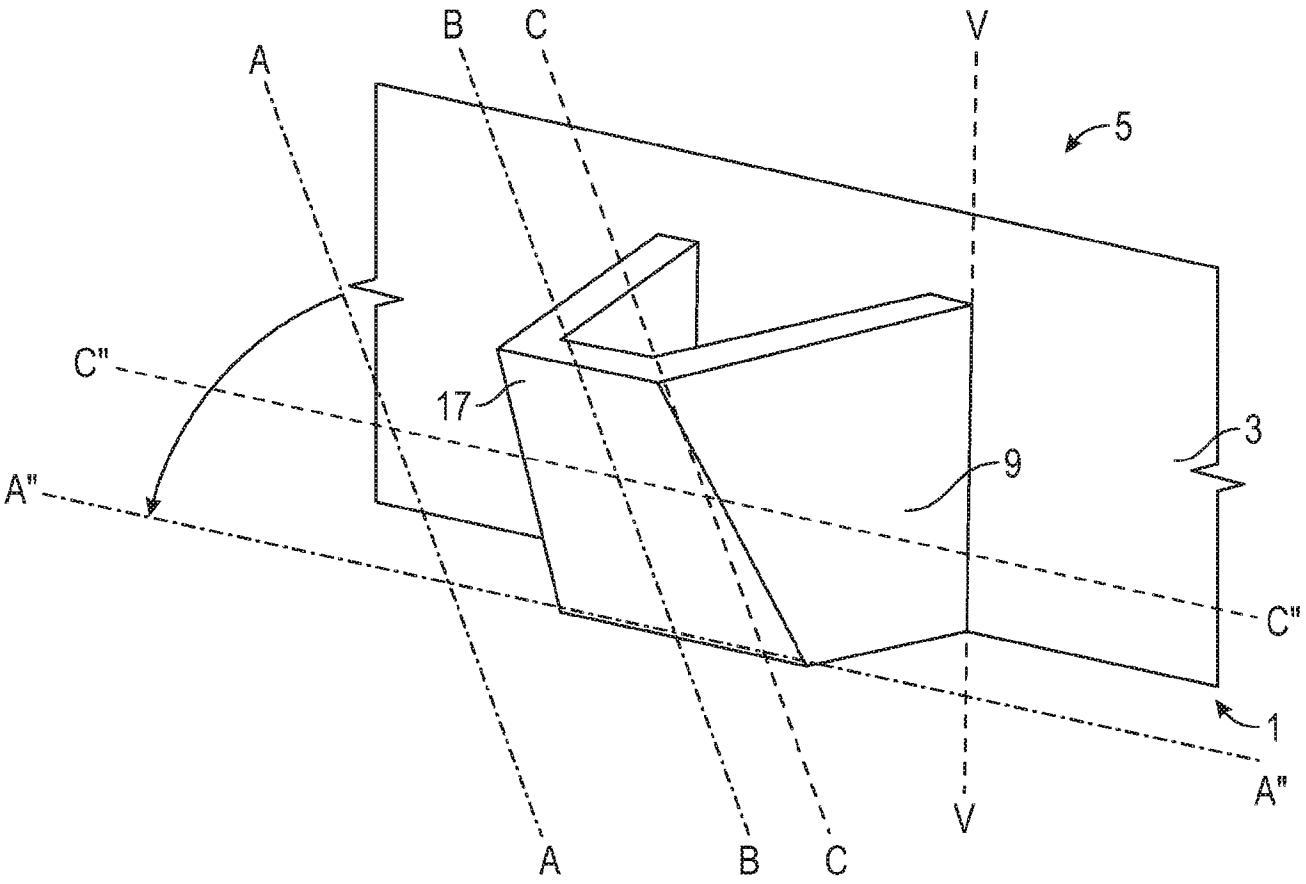
FIG. 3*b* illustrates the second orientation of the electromagnetic mover unit.

FIG. 3*a* shows the resulting flow paths and flow velocities within the well 1 and the initial part 19 of the furnace 5, in a perspective view, with the electromagnetic mover unit 21 in a second orientation. The second orientation is shown in FIG. 3*b*. Here, the primary axis A-A of the electromagnetic mover unit of FIG. 2*b* has been rotated to lie along axis A"-A" and lie perpendicular to the primary axis B-B of the angled front wall 17. The electromagnetic mover unit 21 is effectively a linear motor and so the primary motion axis in the molten metal generated by the magnetic flux is along axis C"-C", once again a rotation through 90° of C-C, again perpendicular to primary axis B-B and parallel to axis A"-A" and hence across the front of the angled front wall 17.

Whilst establishing the primary motion axis C"-C" in FIG. 3*b* is relatively predictable, the actual flow paths and velocities shown in FIG. 3*a* reflect the complexity of the outcome in practice. In zone A at the top surface of the molten metal within the well 1, the flow velocity is relatively low and circulates towards the top of the angled front wall 17 of the well and the top of the side wall 30. This is reflected in the short arrows to indicate direction and velocity. In Zone B at the face of the angled front wall 17 of the well 1, the velocities are slightly higher but still largely circulating in a horizontal direction. The mainly horizontal direction of these two circulating flows provides only a limited ability to draw aluminium chips introduced to Zone A down into the well 1. The main downward flow occurs in Zone B close to the side wall 30 where an abrupt change in direction arises and the flow passes down the side wall 30 and the closest part of the angled from wall 17 In Zone C, low velocities are observed passing across the bottom surface 23 of the well 1 and out of the well 1. Horizontal flow continues into Zone D in the bottom part of the furnace at low velocities. As a consequence of the above flow pattern a lot of the metal in the well 1 recycles over and over within the well 1 in substantially horizontal flows. This results in the temperature of the molten metal within the well 1 dropping and causing problems as heat is not drawn into the well from the furnace, Zone G and beyond. The main problem, however, is the inability of the flow patterns to draw the non-molten metal which is introduced down into the molten metal.

The above examples demonstrate the problems in generalising from the primary motion axis C-C up to the observed flow path, particularly where a single inlet and outlet to the furnace 5 from the well 1 is used.

The applicant has established that there are material advantages in the flow paths and flow velocities to be obtained by careful selection of the orientation of the electromagnetic mover unit. An example is provided in the third orientation shown in FIGS. 4*a* and 4*b*. The electromagnetic mover unit 21 is once again provided on the mounting frame 15 and so is reclined by 30° from the vertical (30o between V-V and B-B and A'-A' in that plane) so as to follow the inclination of the angled front wall 17. Significantly, the electromagnetic mover unit 21 is also inclined relative to the vertical in the third orientation in a second plane at an angle of 8° (the rotation between A-A and A'-A' of angle θ). That is to say the primary axis A'-A' of the electromagnetic mover unit 21 is offset by 8° relative to the primary axis B-B of the angled front wall 17 in the vertical consideration. The primary motion axis in the molten metal generated by the magnetic flux is along axis C'-C' and so this too is reclined by 30° in the first direction and inclined relative to the vertical by 8° in the other. The primary motion axis is reversed in direction compared with that of the first orientation and hence is a lifting motion.

Whilst the change between the first orientation, 0° inclined, and the third orientation, 8° inclined, is small, the impact is significant as can be seen in the details provided in FIGS. 5*a*, 5*b*, 5*c* and 5*d*.

Figure 5A:
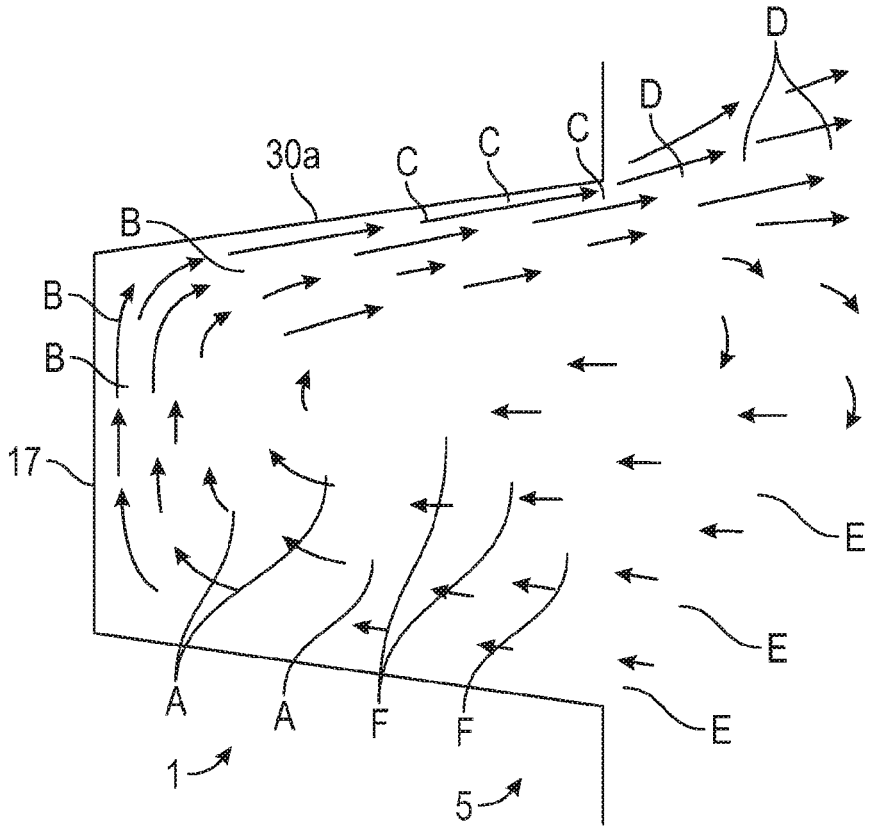
FIG. 5*a* illustrates the flow paths and flow velocities for the embodiment of FIG. 4 in a plan view looking down on the well and first part of the furnace.

FIG. 5*a* illustrates the flow paths and flow velocities for the third orientation in a plan view looking down on the well 1 and first part 25 of the furnace 5. The angle front wall 17 and the side walls 30 of the well 1 are visible, together with part of the side wall 3 of the furnace 5. The primary motion axis C-C is up and slightly across the angled front wall 17.

As a consequence of the above, in Zone A there is a flow across, slightly upward and towards the junction of the angled front wall 17 and side wall 30*a*. This provides strong transportation of the non-molten metal introduced to Zone A.

In Zone B, which in this orientation is focused towards the junction of the angled front wall 17 and the side wall 30*a*, there is increasing velocity, an initial upward and across movement and then a change to a higher velocity downward movement. The downward movement is focussed along the side wall 30*a*. A large part of the metal entering Zone B is drawn from Zone F in the lower and middle part of the well 1. The combination of movements in Zones A, F and B provides a strong motion to submerge the non-molten metal added. This brings the non-molten metal into contact with hot molten metal and moves the non-molten metal quickly away from Zone A as it is processed.

By Zone C, the downward motion and high flow velocities are maintained alongside the side wall 30*a* and then out of the well 1 into the furnace. In Zone D, within the first part 25 of the furnace 5 the flow direction is steered into a more horizontal direction by the bottom surface 32 of the furnace 5. The flow velocity starts to decline as the side wall 30*a* of the well is no longer present to constrain the flow and so the flow can spread out further.

The return flow to the well 1 and the upper part thereof, Zone A can be seen in Zone E and Zone F. In Zone E within the furnace 5 and close to the well, there is a general low velocity flow across a large part of the width of the well 1 into the well. In Zone F the velocity increases under the effect of the electromagnetic mover unit 21 and starts to develop an upward motion as a result and due to the constraining effect of the angled front wall 17. The flow then returns to Zone A and Zone B.

The third orientation ensures good circulation within the furnace 5 and the avoidance of problem zones, such as Zone H in the first orientation above.

In general effect, the twisting of the primary motion axis C-C in the third orientation serves to allow a separate entrance zone from the furnace 5 to the well 1 (middle and lower parts in FIG. 5*a*) and a separate exit zone from the well 1 to the furnace 5 (upper part in FIG. 5*a*) within the same single physical opening between the two. Hence, conflicting flows and reductions in flow velocity and undesirable flow directions are avoided when compared with the first and second orientations, for instance.

Figure 5B:
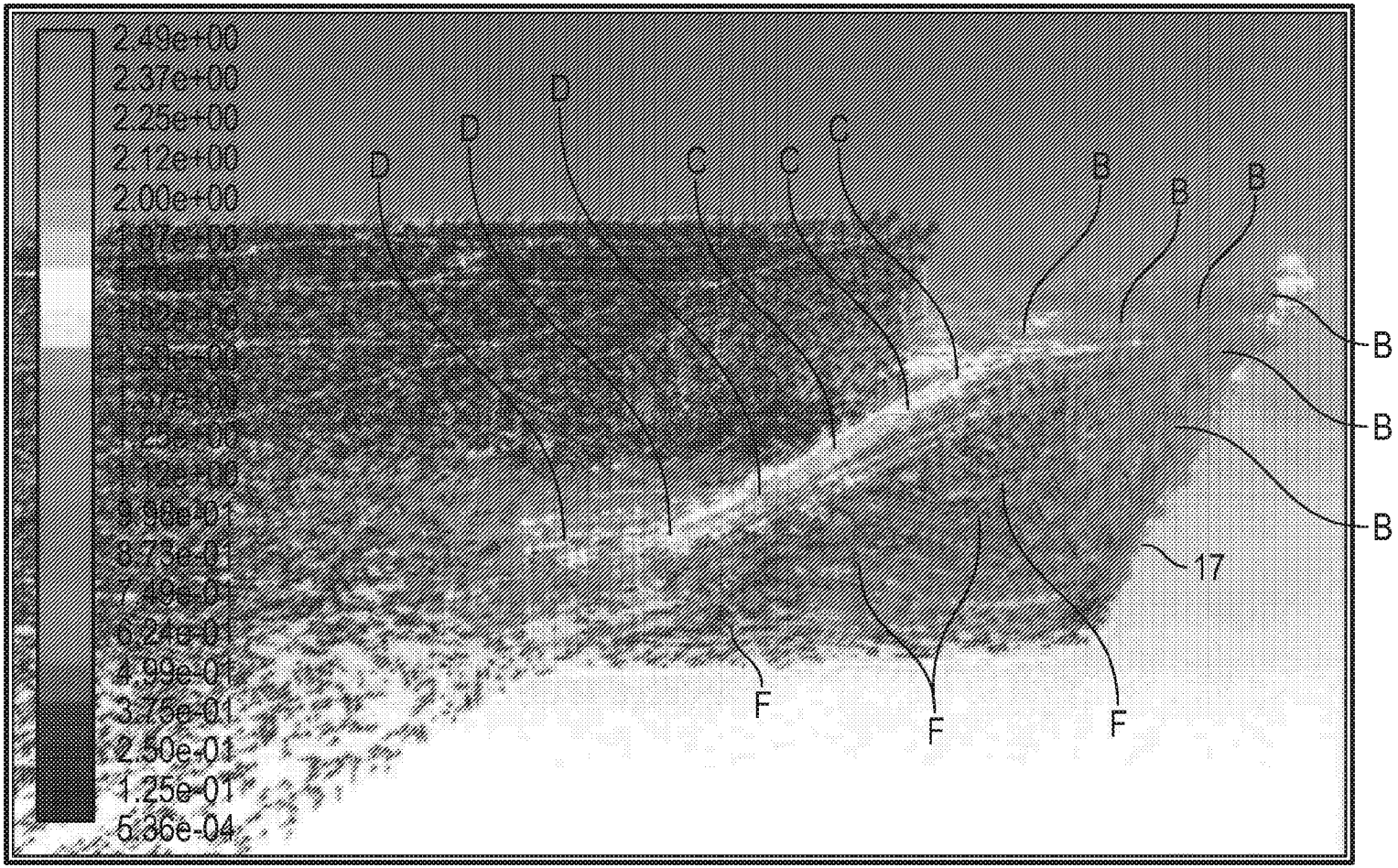
FIG. 5*b* illustrates the flow paths and flow velocities for the embodiment of FIG. 4 in a side view focusing on the section close to the side wall of the well.
Figure 5B:
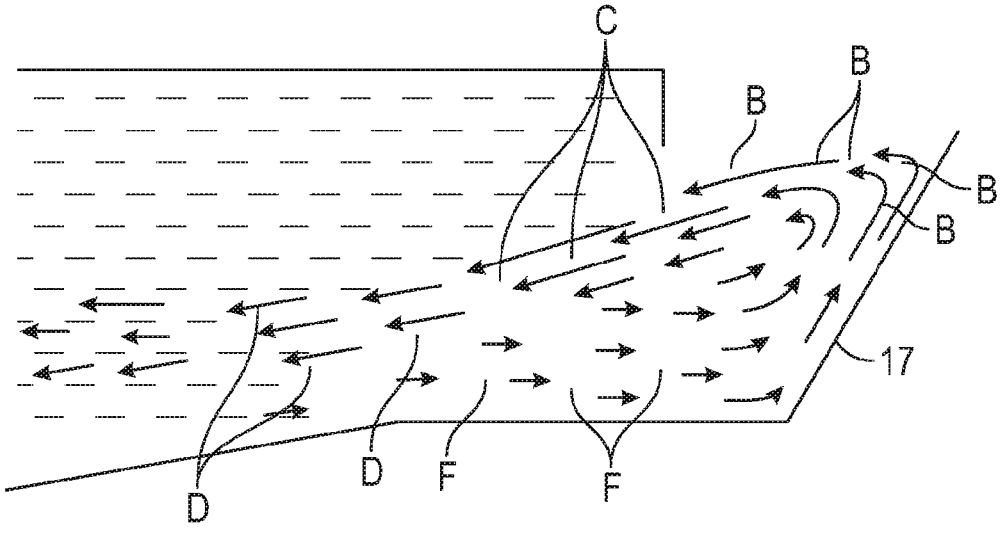

FIG. 5*b* reflects the flow paths and flow velocities for the third orientation too, but as a side view focusing on the section close to the side wall 30*a* of the well 1 it illustrates certain features of the flow paths and flow velocities more clearly. In particular, FIG. 5*b* illustrates the increasing velocity, initial upward movement and then a change to a higher velocity downward movement in Zone B. The downward movement and movement along the side wall 30*a* is a clear feature.

FIG. 5*b* also provides the clearest illustration of Zone C and its downward motion and high flow velocities alongside the side wall 30*a* and then out of the well 1 into the furnace 5. The jet like flow path in Zone C is apparent in FIG. 5*b*. In Zone D, the flow being steered into a more horizontal direction by the bottom surface 32 of the furnace 5 is also apparent.

The majority of the flow through Zone E is behind the jet of Zone C in FIG. 5*b* and so is not so apparent, but the continuation of this flow into Zone F along the bottom of the furnace 5 and well 1 and rising upward is apparent.

Figure 5C:
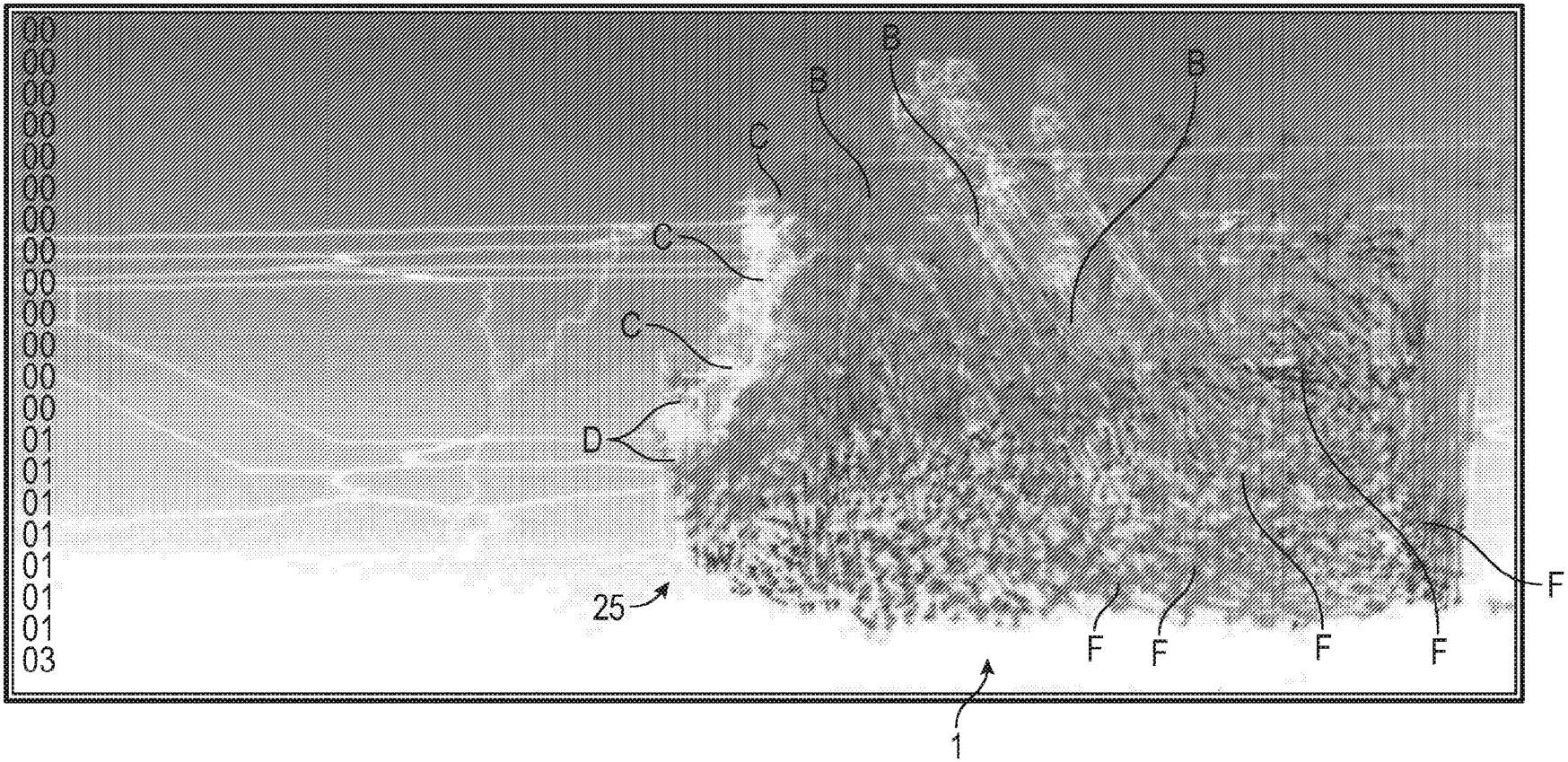
FIG. 5*c* illustrates the flow paths and flow velocities for the embodiment of FIG. 4 in an end view of the well, but including flow within the furnace.
Figure 5C:
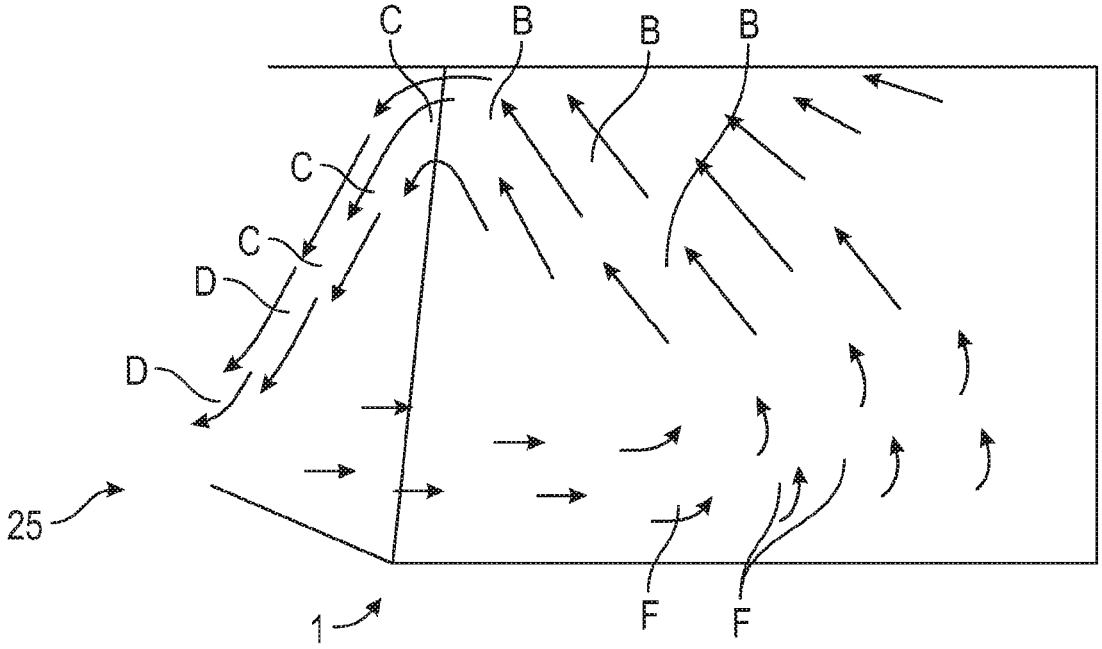

FIG. 5*c* views the well 1 and the first part 25 of the furnace 5 through the angled front wall 17 of the well 1. It shows the upward and across flow of Zone B and the downward turn and high velocity of Zone C. It also shows the low velocity return flow in Zone F which maintains the circuit for the flow of molten metal without any conflicting flows.

The flow paths and flow velocities of the third orientation are beneficial in the context of the well 1 and the first part 25 of the furnace 5 as shown above. However, the benefits also extend out into the wider parts of the furnace. These benefits are shown in FIG. 5*d* in terms of the flow paths and flow velocities for the third orientation.

Figure 5D:
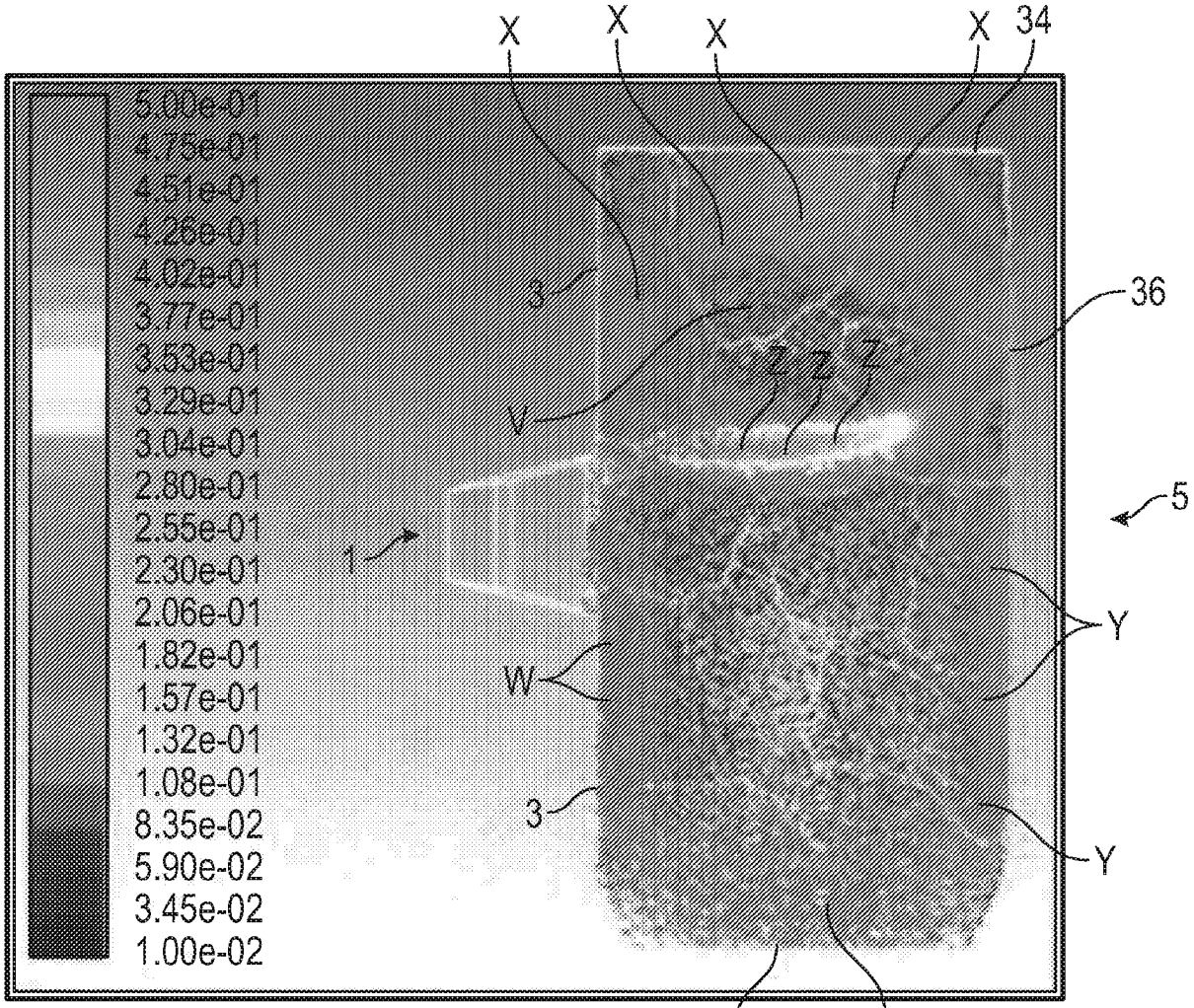
FIG. 5*d* illustrates the flow paths and flow velocities for the embodiment of FIG. 4 in a plan view focusing on the furnace.
Figure 5D:
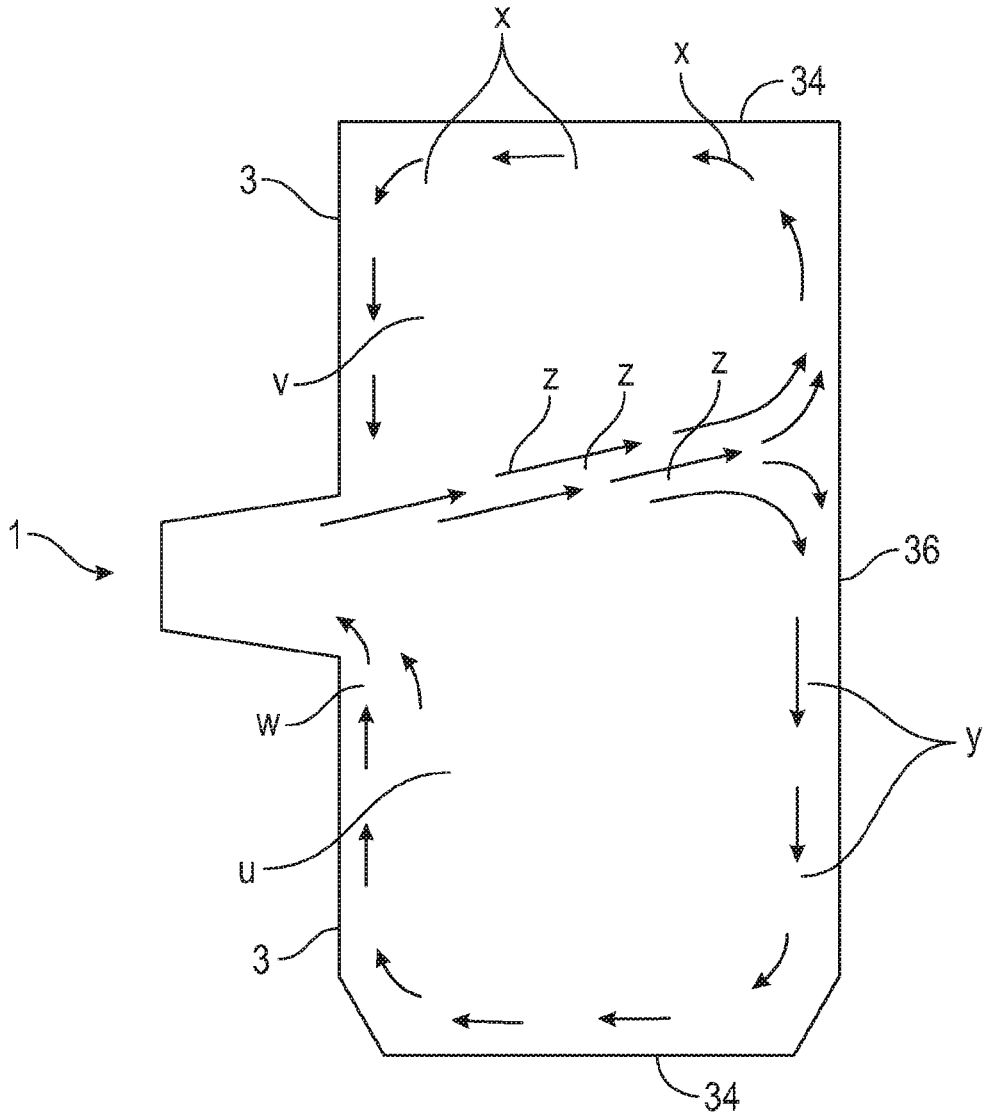

FIG. 5*d* shows in plan view the entirety of the furnace 5. This includes the well 1 (the flow within which is omitted for clarity purposes) and the side wall 3 of the furnace 5. The end walls 34 and the opposing side wall 36 complete the profile of the furnace 5. A high velocity, horizontal flow across the furnace 5 is shown from Zone Z of the furnace 5. This corresponds to the continuation of the jet like flow path in Zone C above. This flow path crosses the furnace 5 and then splits to produce two counter direction peripheral flow paths in Zone X and Zone Y. These flow paths continue around the outside of the furnace 5 and return metal to the entrance to the well 1 at Zone W. The central Zone U, between Zone Y and the high flow velocity of Zone Z, and the central Zone V, between Zone X and the high velocity of Zone Z, are both relatively low velocity zones. However, there is still more than sufficient flow velocity of the desired flow pattern within the furnace 5 as a whole to ensure even distribution of molten metal, the newly added and melting or melted metal and the even distribution of heat within the furnace 5.

Whilst in the third orientation described in detail above, an angle of 8° relative to the vertical is provided together with a lifting motion, other angles relative to the vertical can be employed. Decreases in the angle relative to the vertical are possible, 5° to 8°, whilst still generating lift to the molten metal and still forming a preferential flow out of one side of the well and a return flow on the other side. Lower angles 3° to 5° may still offer some separation of the flows in some well/furnace configurations, but are less optimal. Higher angles are certainly possible, with 8° to 15° expected to offer similar separation of flows and good flow velocities out into the furnace 5 from the well 1. Still higher angles, 15° to 35°, are expected to still offer good lifting and hence downward and outward flow paths and velocities to one side of the well in preference to the other to still give good submergence rates for the non-molten metal. Higher angles 35° to 50° are expected to give reasonable submergence for the scrap and preferential flow to the side of the well out into the furnace, but are likely to be able to handle decreasing volumes feed rates of non-molten metal feed.

To maximise the amount of low reluctance material between the ends of the teeth in the inductor of the electromagnetic mover unit 21 and the molten metal in the container, it is desirable to use a metal plate on the opposing face of the angled front wall 17 of the well 1. This allows a thinner wall to be used than if a purely refractory wall is used. The metal plate also has a lower reluctance per unit thickness than a refractory wall. A 10 mm metal plate and 270 mm refractory thickness represent a useful configuration. No cooling of the plate is provided, but air cooling of the inductors.

As described above in the third orientation, the electromagnetic mover unit 21 is operating with the primary motion axis set to the upward direction. This lifts the molten metal up and across the angled front face before it falls again in Zone B and C. The embodiment includes the possibility of occasionally and/or periodically reversing the current to the electromagnetic mover unit 21 and hence reversing the primary motion axis C-C. This reversal might be applied for a shorter period of time compared with the usual direction. The reversal might be used to clean or purge the well 1 and surround parts of the furnace 5 of any build-up of metal as the reversal will produce higher velocities in many of the areas having a lower velocity when in the usual direction.

A variety of inductor designs are possible for the electromagnetic mover unit 21, but a three phase design is preferred.

In the third orientation described in detail above, an angle of 8° relative to the vertical is provided and used throughout the processing. The option to reverse the current and hence the primary motion axis C-C still retains the electromagnetic mover unit 21 at that same inclination.

In addition to the operation of the electromagnetic mover unit 21 in the third orientation described above, it is possible to vary the angle of the orientation at different stages or times. For instance, during start up and/or after tapping when the volume of molten metal in the furnace 5 and hence in the well 1 is low, no non-molten metal may be being fed to the well 1 and the focus might be on merely stirring the existing molten metal. In that instance, the inclination of the electromagnetic mover unit 21 may be much greater, for instance up to the 90° angle used in the second orientation. This could give the strongest stirring effect with the limited molten metal present and the absence of the ability to submerge non-molten metal is not important in this stage as there is no such non-molten metal to handle. A single step, multiple step or continuous movement to the next orientation, such as the third orientation, could then be provided. This would provide the orientation best suited to submergence of non-molten metal. The movement may be controlled according to a pre-determined sequence and/or based upon feedback from sensors associated with the well 1 and/or furnace 5 and/or their contents.

Figure 4A:
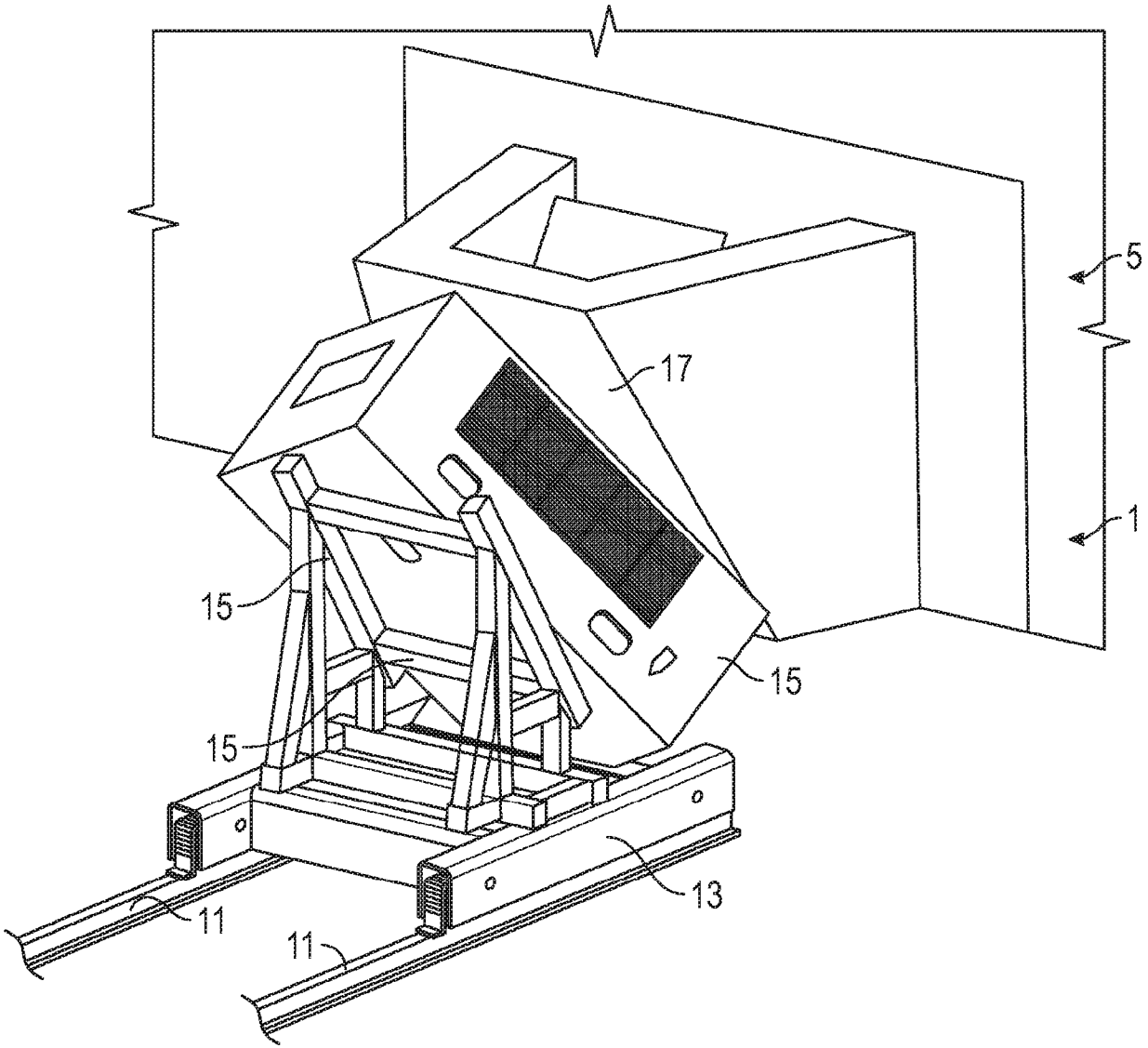
FIG. 4 illustrates a third orientation of the electromagnetic mover unit according to the present invention.
Figure 4B:
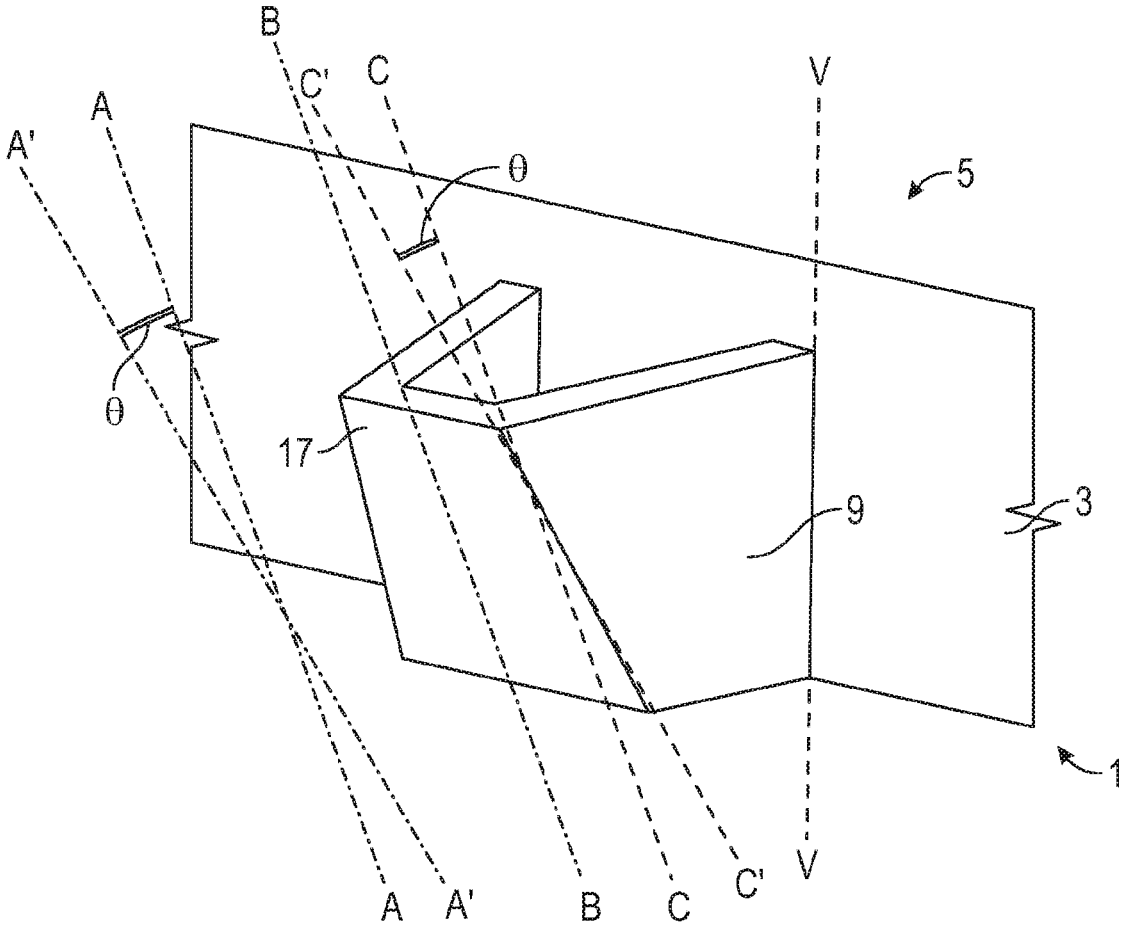
Figure 6:
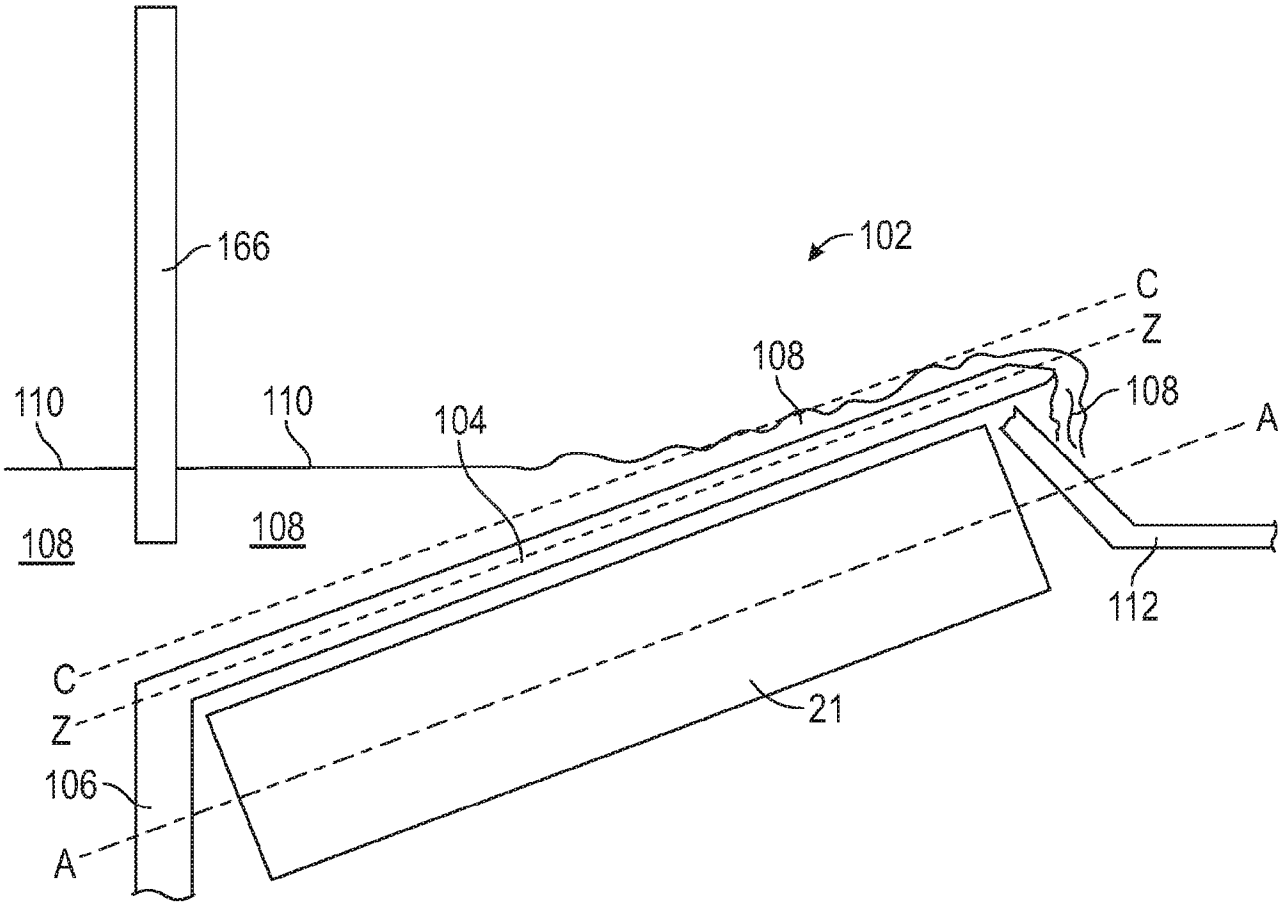
FIG. 6 illustrates the use of an embodiment of the invention to transfer molten metal out of a furnace or other container.

As can be seen in FIG. 4*a*, the electromagnetic mover unit 21 is moveable from one location to another. The electromagnetic mover unit 21 may be put to different uses and/or operate in different inclinations and extents of recline at the different locations. For instance, the electromagnetic mover unit 21 may be removed from the scrap submergence well 1 shown in FIG. 4*a* and move to a metal transfer location as shown in FIG. 6. Once again rails are used to allow the moveable cradle 13 to be brought into an operative position (as shown) relative to the transfer well 102.

The cradle 13 includes an adjustable mounting frame 15 and that has been adjusted so as to present the electromagnetic mover unit 21 at a much more reclined angle, for instance >50°. Once again, the mounting frame 15 presents the electromagnetic mover unit to the angled front wall 104 of the transfer well 102. The angled front wall 104 of the transfer well 102 may always be at this angle or may be at this angle because the container 106 (potentially the same furnace 5 as above) has been tipped to assist in emptying the container 106.

Once in position, the electromagnetic mover unit 21 has a primary motion axis C-C aligned with the centre axis Z-Z of the angled front wall 104 of the transfer well 102. Application of current such that the primary motion is upward then causes the molten metal 108 in the transfer well 102 to be lifted up the angled front wall 104 to a level above the resting level 110 in the container 106. This causes the molten metal 108 to fall into a transfer launder 112 or transfer container and hence be removed from the container 106. Once again, to maximise the amount of low reluctance material between the ends of the teeth in the inductor of the electromagnetic mover unit 21 and the molten metal in the container 106, a metal plate on the opposing face of the angled front wall 104 of the transfer well 102 is provided. A 10 mm metal plate and 100 mm refractory thickness represent a useful configuration. The metal plate preferably extends around 100 mm above the resting level 110 of the molten metal 108 in the container 106. The arrangement allows high volumes of molten metal to be discharged in short timeframes, using the same electromagnetic mover unit 21 as already used for another purpose. The electromagnetic mover unit 21 can be completely removed to allow tipping or further tipping of the container 106.

The invention claimed is:

1. A method of moving molten metal within a furnace, the method comprising: providing an apparatus including an electromagnetic mover adjacent to an inlet portion of the furnace, wherein the electromagnetic mover has a primary motion axis aligned along a direction of the maximum linear force generated by the electromagnetic mover; adjusting an orientation of an adjustable mounting frame to adjust a position of the electromagnetic mover from a first orientation to a second orientation; applying a current to the electromagnetic mover such that changes in magnetic field configuration cause movement of the molten metal within the furnace; wherein the furnace includes: the inlet portion that is at least partially defined by a front wall of the furnace that is inclined relative to a vertical axis of the furnace, a bottom wall, and a sidewall defining an opening; a furnace portion that is at least partially defined by the sidewall of the furnace and fluidly connected to the inlet portion via the opening; wherein, in the second orientation, the primary motion axis is inclined relative to a vertical axis of the furnace in two different planes; or wherein, in the second orientation, a longitudinal axis of the electromagnetic mover is inclined relative to the vertical axis in two different planes.

2. A method according to claim 1, wherein the primary motion axis is inclined relative to the vertical in a first plane due to the electromagnetic mover being reclined away from the furnace, the electromagnetic mover being reclined such that an upper part of the electromagnetic mover is further from the furnace than the lower part of the electromagnetic mover.

3. A method according to claim 1, wherein the primary motion axis is inclined relative to the vertical in a second plane due to the electromagnetic mover being rotated from the vertical, the electromagnetic mover being inclined such that an upper part of the electromagnetic mover is to a left side or right side of the front wall of the furnace and a lower part of the electromagnetic mover is to the other of the right side or the left side of the front wall of the furnace.

4. A method according to claim 1, wherein the longitudinal axis is inclined relative to the vertical in a first plane due to the electromagnetic mover being reclined away from the furnace portion, the electromagnetic mover being reclined such that an upper part of the electromagnetic mover is further from the furnace portion than the lower part of the electromagnetic mover.

5. A method according to claim 1, wherein the longitudinal axis is inclined relative to the vertical in a second plane due to the electromagnetic mover being rotated from the vertical, the electromagnetic mover being inclined such that an upper part of the electromagnetic mover is to a left side or right side of the front wall of the furnace and the lower part of the electromagnetic mover is to the other of the right side or the left side of the front wall of the furnace.

6. A method according to claim 1, wherein the furnace provides a feed route for non-molten metal to the inlet portion of the furnace portion; or the furnace includes an exit route for molten metal from the inlet portion of the furnace portion to a third container.

7. Apparatus for moving molten metal in a furnace, the apparatus comprising:

an electromagnetic mover having a primary motion axis; and an adjustable mounting frame configured to support the electromagnetic mover, and adjust a position of the electromagnetic mover relative to a furnace having an inlet portion that is at least partially defined by a front wall of the furnace that is inclined relative to a vertical axis of the furnace and a furnace portion that is at least partially defined by side walls of the furnace and fluidly connected to the inlet portion via an opening in the inlet portion;

wherein, the mounting frame being adjustable between a first orientation and a second orientation; and wherein, while the mounting frame is in the second orientation:

the primary motion axis of the electromagnetic mover is aligned along a direction of maximum linear force generated by the electromagnetic mover, and is inclined relative to the vertical axis in two different planes; and the electromagnetic mover is adjacent the front wall of the inlet portion.

8. Apparatus according to claim 7, wherein the primary motion axis corresponds to a primary axis along which molten metal moves, and the primary motion axis is parallel to a longitudinal axis of the electromagnetic mover.

9. Apparatus according to claim 7, wherein the primary motion axis is inclined relative to the vertical axis in a first plane such that an upper part of the electromagnetic mover is further from the furnace accommodating the molten metal than a lower part of the electromagnetic mover.

10. Apparatus according to claim 9, wherein while the mounting frame is in the second orientation the primary motion axis is inclined relative to the vertical axis in a first plane by between 20° and 65°.

11. Apparatus according to claim 7, wherein the primary motion axis is inclined relative to the vertical axis in a second plane such that an upper part of the electromagnetic mover is to a left side or a right side of a front wall of the furnace and a lower part of the electromagnetic mover is to the other of the right side or the left side of the front wall of the furnace.

12. Apparatus according to claim 11, wherein the primary motion axis is inclined relative to the vertical axis in a second plane by between 3° and 50°.

13. Apparatus according to claim 7, wherein the linear force is directed upward along the primary motion axis.

14. Apparatus according to claim 11, wherein the mounting frame is configured to support the electromagnetic mover at a plurality of different inclinations along the second plane relative to the vertical axis.

15. Apparatus according to claim 9, wherein, while the mounting frame is adjustable to a third orientation in which the electromagnetic mover is reclined in the first plane relative to the vertical axis at an angle that is between 30 and 90 degrees and inclined relative to the first orientation by 8 degrees.

* * * * *